US005140749A

United States Patent [19]

Sailas

[11] Patent Number: 5,140,749

[45] Date of Patent: Aug. 25, 1992

[54] METHOD FOR THE MANUFACTURE OF ROLLS OR CYLINDERS OF A PAPER MACHINE AND ARTICLES PRODUCED THEREBY

[75] Inventor: Väinö Sailas, Vaajakoski, Finland

[73] Assignee: Valmet Paper Machinery Inc., Finland

[21] Appl. No.: 692,312

[22] Filed: Apr. 26, 1991

Related U.S. Application Data

[63] Continuation of Ser. No. 455,582, Dec. 22, 1989, abandoned.

[30] Foreign Application Priority Data

Jan. 9, 1989 [FI] Finland ..... 890106

[51] Int. Cl.[5] ..... B21B 31/08

[52] U.S. Cl. ..... 29/895.2; 29/895.3; 29/124; 29/132

[58] Field of Search ..... 29/110, 124, 132, 895, 29/895.2, 895.22, 895.3, 425, 411, 412; 219/121.13, 12.14; 409/131; 147/35.5

[56] References Cited

U.S. PATENT DOCUMENTS 3,029,504 4/1962 Nielsen ..... 29/425 X 3,186,063 6/1965 Dopp ..... 29/124

3,221,536 12/1965 Seulen et al. ..... 29/895 X 4,176,270 11/1979 Sailas ..... 219/121.14

FOREIGN PATENT DOCUMENTS 0198243 12/1982 Japan ..... 29/132

*Primary Examiner*—Joseph M. Gorski

*Assistant Examiner*—S. Thomas Hughes

*Attorney, Agent, or Firm*—Steinberg & Raskin

[57] ABSTRACT

A method for the manufacture of the cylindrical mantle (10) of the rolls or cylinders of a paper machine out of a corrosion-proof metal or alloy material, particularly refined steel, comprises cutting oblong plate blanks (20A) of a length equal to the total length of the roll mantle to be manufactured. The plate blanks (20A ) are machined or bent to mantle portions (20) of a cross-sectional shape equal to a part of a circular ring. Out of the mantle portions (20), the cylindrical mantle of a roll or cylinder is assembled by joining the mantle portions (20) together by means of axial welding joints (14) prepared by electron-beam welding performed in the vacuum chamber of an electron-beam aparatus by using a number of mantle portions (20) per one roll mantle (10). A roll or cylinder manufactured by means of the method is also described.

7 Claims, 3 Drawing Sheets

METHOD FOR THE MANUFACTURE OF ROLLS OR CYLINDERS OF A PAPER MACHINE AND ARTICLES PRODUCED THEREBY

This is a continuation of application Ser. No. 07/455,582, filed Dec. 22, 1989 now abandoned.

BACKGROUND OF THE INVENTION

The invention concerns a method for the manufacture of the cylindrical mantle of the rolls or cylinders of a paper machine out of a corrosion-proof metal or alloy material, particularly of refined steel, and particularly for the manufacture of the cylindrical mantle to be perforated for a suction roll of a paper machine.

The invention also concerns a roll or cylinder of a paper machine, in particular a suction roll provided with a perforated mantle, comprising a cylindrical mantle and end pieces attached to both of its ends, in connection with which end pieces there are the axle journals of the roll or cylinder.

Rolls of paper machines, in particular suction rolls, operate in an environment which is highly corrosive. Moreover, suction rolls, in particular press rolls, are subjected to high dynamic loads, because at present the linear loads employed, e.g., in press rolls are of an order of 70–120 kN/m or even higher. This is why, in the mantles of suction rolls or the equivalent, it is necessary to use extensively alloyed special steels, such as two-phase, i.e. so-called duplex steels, which are expensive and difficult to work when cold. Problems of strength in the case of the mantles of suction rolls are also caused by the fact that their mantles are perforated, one mantle comprising typically about 500,000 suction holes.

The diameters of prior-art suction rolls are, as a rule, of an order of 600 . . . 1400 mm, and their wall thicknesses are 55–90 mm, in the case of large paper machines usually 70–90 mm. The lengths of the suction rolls correspond to the width of the paper machine, being usually within a range of 5–10 m.

The cylindrical mantles of suction rolls or equivalent for paper machines are, in prior art, manufactured by means of the following techniques. The cylindrical mantles are bent by being rolled out of a plate almost to the shape of a full circle or a semicircle, and the longitudinal joint or joints is/are welded together. Correspondingly, it is known in the prior art to bend cylindrical mantles from a plate to a curved shape by chamfering to a semicircular shape, whereupon the longitudinal joints of the cylinder halves are welded together. Chamfering can, as a rule, be employed up to a mantle wall thickness of about 50–70 mm only. Hereupon the cylindrical mantle made by rolling or chamfering is machined to cylindrical shape.

In the prior art, cylindrical mantles for paper machine rolls or cylinders are also manufactured by means of centrifugal casting. In this casting process the casting mould is made to revolve in a horizontal position, e.g., on rolls, and molten metal is fed into the mould, said metal remaining and solidifying on the mould walls by the effect of centrifugal forces.

Since the wall thicknesses of suction rolls and equivalent are quite high (55–90 mm), the rolling and chamfering of the plate material requires particularly robust equipment and high forces. In spite of this, for example when rolling is used, the roll mantle must be composed of axial parts of a length of about 2–3 m. With larger mantle thicknesses, higher than about 70 mm, rolling is not possible except by means of particularly robust equipment or by using very short mantle portions which are hot. Thus, with higher mantle thicknesses, it has been necessary to use chamfering, by which means it is, however, difficult to bring the mantle to precisely circular shape, which results in the drawback that large quantities of material must be machined off the mantle. This increases the time taken by the machining and the loss of material.

In a mantle manufactured by rolling or chamfering, it has been necessary to use transverse welding joints, which has resulted in the following drawbacks. In practice it has been noticed that the major part of the suction rolls are broken down by breaking off so that mostly the breaking point is exactly at the location of a transverse weld when the roll has been manufactured by welding. The points of starting and ending of a transverse weld are particularly risky problem points. This is why one of the main objectives of the present invention is to provide a process for the manufacture of a roll mantle and a roll or cylinder manufactured by means of said method wherein there are no transverse joints at all.

It is a drawback in the use of centrifugal casting methods that about one half of the wall thickness must be machined before a "sound" roll mantle is obtained. It is a further drawback that casting flaws tend to remain in the roll mantle, said flaws constituting starting points for fractures. A considerable drawback is the above proportion of material lost on machining, because the extensively alloyed steels used in roll mantles are very expensive.

OBJECTS AND SUMMARY OF THE INVENTION

The overall object of the present invention is to provide a novel method and a paper machine cylinder and roll manufactured by means of said method, in particular a suction roll provided with a perforated mantle, wherein the drawbacks mentioned above and those that will come out later can be avoided for the most part.

An object of the present invention is to provide a method for the manufacture of mantles for paper rolls or cylinders out of a corrosion-proof metal or alloy material, particularly refined steel, by means of which method the manufacture of the mantle can be carried out with maximal economy in consideration of the cost of the material of the mantle to be manufactured, of the time of manufacture, of the stock of machines required, and of the energy cost.

In order to achieve the objectives stated above and those that will come out later, the method of the invention comprises a combination of the following steps:

a) out of corrosion-proof metal or alloy material, particularly out of refined-steel plate material, oblong plate blanks of a length equal to the total length of the roll mantle to be manufactured are cut;

b) the plate blanks are machined to mantle portions of a cross-sectional shape equal to a part of a circular ring;

c) out of the mantle portions, the cylindrical mantle of a roll or cylinder is assembled by joining the mantle portions together by means of axial welding joints prepared by electron-beam welding performed in the vacuum chamber of an electron-beam apparatus, by using at least 6 pcs., most appropriately 10–16 pcs., preferably at the maximum 70 pcs., of mantle portions per one roll mantle;

d) the roll mantle is machined to cylindrical shape at least on the outside, most appropriately both on the inside and on the outside.

The roll and cylinder in accordance with the invention is mainly characterized in that the roll or cylinder comprises a cylindrical mantle which is composed of, most appropriately 6–20, preferably at the maximum 70, oblong axial parts, which mantle portions are joined together without transverse joints by means of unified longitudinal axial joints extending over the entire length of the roll mantle and prepared by means of electron-beam welding.

In the invention the roll or cylinder mantle is composed of a number of oblong plate pieces of a length equal to the length of the whole roll mantle, which pieces have, most appropriately, been first machined to mantle portions of a shape equal to a part of a circular ring. As a rule 6–20, most appropriately 10–16 machined blanks are used per roll mantle.

In some special cases, when the wall thickness of the roll manufactured by means of the method in accordance with the invention is of an order of 40–70, it is possible to bend the plate pieces of a length equal to the length of the whole roll mantle first to the shape of a part of a circular ring, and in such a case, in one mantle, it is possible to use, e.g., only 4–6 plate blanks.

It is an essential feature of the invention that the plate blanks are welded together by means of welding joints parallel to the axial direction of the roll expressly by means of electron-beam welding (EB-welding).

When EB-welding is applied to the invention, at one time, several advantages of different types as well as synergy are obtained. Of these advantages it should be mentioned that, when EB-welding is used, the thermal energy that is required is only about one hundredth as compared with conventional welding methods, whereby the deformations of the roll mantle can be made small in spite of the high total length of the welding joint. This property of EB-welding results from the high energy density in EB-welding. When EB-welding is used, the requirement of after-machining of the roll mantle becomes little, because there is small burring at a joint made by EB-welding. Moreover, by means of an electron beam, an excellent quality of the welding joint as well as, in the invention, a reasonable welding speed are obtained, when considering the relatively large length of welding joint needed per roll. The EB-welding can be carried out from inside and/or from outside the roll mantle. It is a further advantage that EB-welding can, as a rule, be carried out without using filler materials, even though, in some special cases, filler materials may be used. When EB-welding is used, the welding parameters can be determined precisely and, as is shown by the example to be given later, in the manufacture of the roll mantle the welding time does not become excessively long or even a decisive factor, but the time taken by the machining of the plate blanks is even longer.

When the invention is applied, it is preferable to bind the plate blanks together by means of a special tool, whereupon the EB-welding is carried out in a way known in the prior art in a vacuum chamber from inside and/or from outside the roll mantle by means of one or several welding heads travelling in the axial direction of the roll.

In the invention, the number of the plate blanks to be used is chosen by performing a process of optimization with respect to the costs of the machining, in consideration of the loss of material arising in said machining, and with respect to the sum of the costs of the EB-welding. In such a case, as a rule, the conclusion is that the roll mantle is composed of 6–20 parts, most commonly of 10–16 parts. In the case of large objects, e.g. a Yankee cylinder (diameter of an order of about 10 m) the number of the parts may, of course, exceed these numbers (the number being, e.g., 60–70 pcs.). When a roll mantle material of lower cost is used, it is possible to use six plate blanks, in which case the loss of material becomes higher, but the length of the welding joint is reduced accordingly. The higher the cost of the roll mantle material that is used, the higher the number of plate blanks that can be optimally used.

The advantages provided by the invention are particularly in the manufacture of suction rolls for a paper machine. However, by means of the method in accordance with the invention, it is also possible to manufacture cylinders for a paper machine, such as drying cylinders or Yankee cylinders, as well as various solid-mantle rolls for a paper machine, such as center rolls for a press.

By means of the method in accordance with the invention, the roll mantles are made of corrosion-proof and weldable metal or alloy materials, particularly extensively alloyed stainless steels, often so-called two-phase or duplex steels, such as CrNi-alloyed steels with a low content of carbon.

BRIEF DESCRIPTION OF THE DRAWINGS

In the following, the invention will be described in detail with reference to some advantageous exemplifying embodiments of the invention illustrated in the figures in the accompanying drawing, the invention being by no means strictly confined to said embodiments.

DESCRIPTION OF THE PREFERRED EMBODIMENTS

Figure 2:
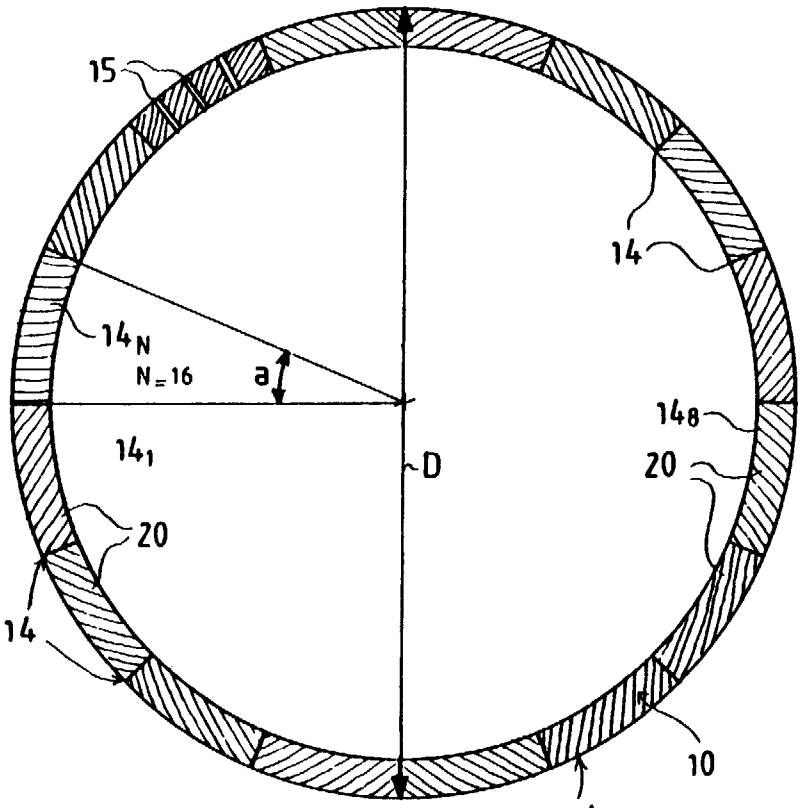
FIG. 2 is a sectional view taken along the line II—II in FIG. 1.
Figure 1:
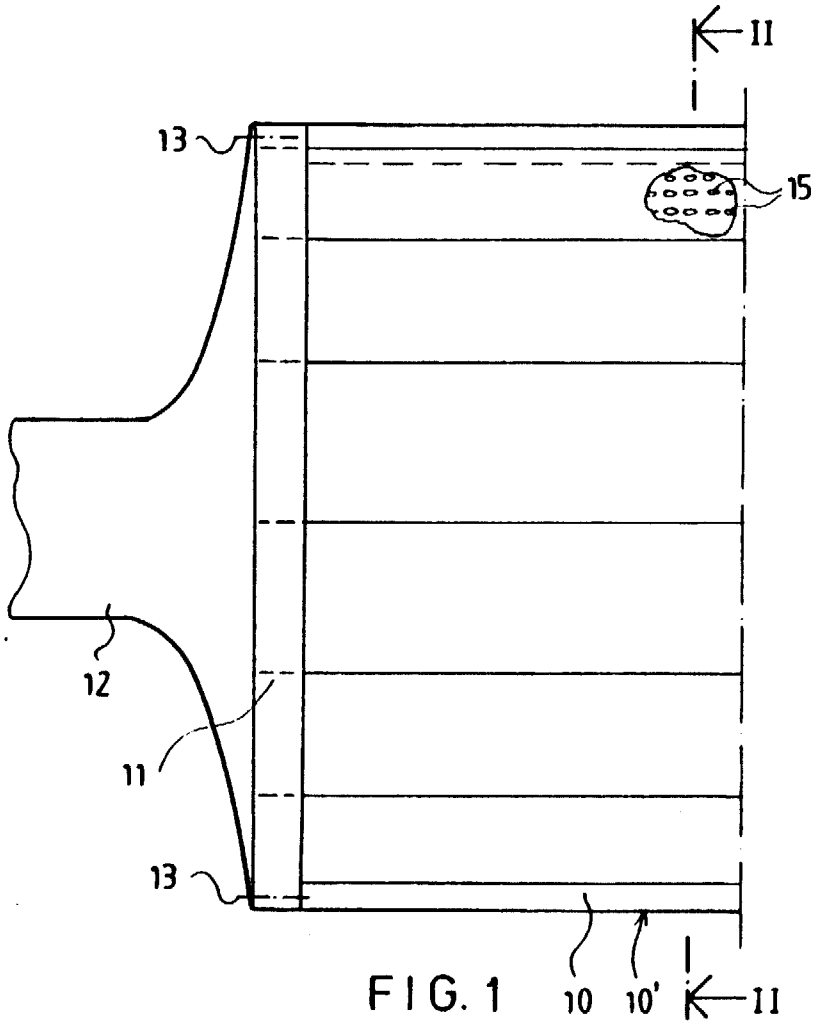
FIG. 1 is a schematical illustration of a portion of a suction roll manufactured by means of the method of the invention.

FIGS. 1 and 2 are schematical illustrations of a suction roll manufactured by means of the method in accordance with the invention. The suction roll comprises a mantle 10, which has an outer face 10' which has been machined smooth. The mantle 10 is provided with a through perforation 15, which operates as the suction duct between the suction box (now shown) provided inside the suction roll and the outside atmosphere. Ends 11 have been attached to both ends of the mantle 10 of the suction roll by means of screws 13 or equivalent, these ends being provided with axle journals 12.

Figure 3:
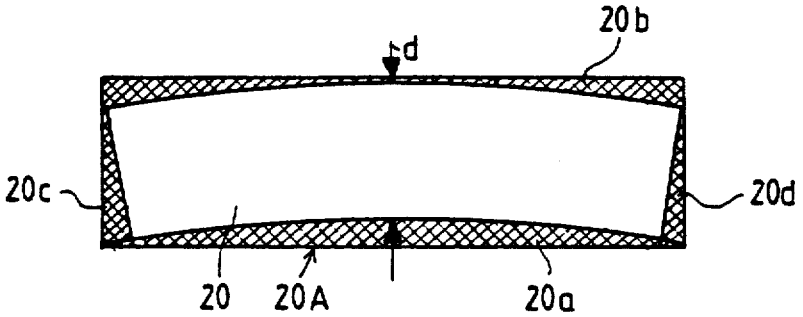
FIG. 3 shows a cross-section of a plate blank used in the invention.

The roll mantle 10 shown in FIGS. 1 and 2 is manufactured by means of the method in accordance with the invention, e.g., as follows. Plate blanks 20A of a cross-sectional shape of a rectangular prism and of a length equal to the length of the whole roll mantle 10 are cut out of a plate of suitable thickness d. The plate blanks 20A are machined by milling and/or by planing so that the plate blank 20A is converted to mantle portions 20 of the shape equal to a part of a circular ring and of a length equal to the length of the whole roll mantle. In FIG. 3, the inner part 20*a*, the outer part 20*b*, and the side parts 20*c* and 20*d* to be machined off the plate blank 20A are indicated by means of crosswise shading.

According to FIGS. 1 and 2, the number of said mantle portions 20 used per roll mantle 10 is 16 pcs., and in FIG. 2 said parts are denoted with the reference numerals $14_1$–$14_N$. As was stated above, N is chosen as equal to 6–20, most appropriately N=10–16. When N=16, the central angle a of one mantle portion 20 is a=22.5°. In the case of very large objects, such as Yankee cylinders, the central angle may also be smaller, e.g., about 5–18.

The above sixteen (16 pcs.) mantle portions 20 of a length equal to the length of the whole roll mantle are assembled in a tool made for the purpose as a closed cylinder mantle. The mantle blank assembled in this way is transferred into the vacuum chamber in the EB-welding machine, and the welding together of the mantle portions 20 by means of axial joints 14 is carried out by means of the EB-welding device shown in FIGS. 4 and 5, whereby the axial joints 14 are formed in the mantle 10, these joints being continuous and having a length equal to the entire length of the roll mantle 10.

Figure 3A:
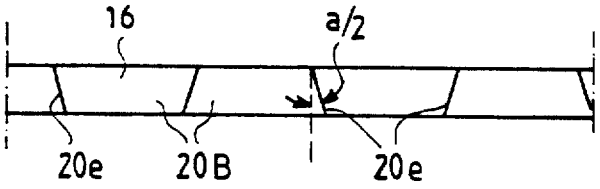
FIG. 3A shows a cross-sectional view of an alternative method of cutting of a plate blank.

FIG. 3A illustrates an alternative method of cutting the plate 16 into the plate blanks 20B used in the invention. According to FIG. 3A, the plate blanks 20B are cut to trapezoidal section so that the angle of the cuts 20*e* corresponds to the central angle a of the mantle portion 20 made of the blank 20*a*. Out of the plate parts in accordance with FIG. 3A, the mantle blank can be assembled without machining, and the machining of the mantle from inside and from outside to circular shape is carried out only after the parts 20 have been welded together by means of EB-welding joints.

In some special cases, in particular when N is quite large, the invention can also be carried out so that only the lateral machinings 20*c* and 20*d* are performed on the plate blank 20*a*, whereas the machining 20*b* of the outside, and possibly also the machining 20*a* of the inside, is carried out only after the creation of joint 14 by means of EB-welding, most appropriately in the same way as the mantle is after-machined.

After the mantle in accordance with the invention has been assembled out of its parts 20, its heat treatment is carried out in a way known in the prior art. The heat treatment takes place most appropriately when the mantle is placed standing vertically, so that no detrimental deformations or strains are formed in it.

In the following, two non-restrictive examples will be given on suitable welding parameters and on the speed of preparation of the joint 14 obtained by means of said parameters.

Figure 4:
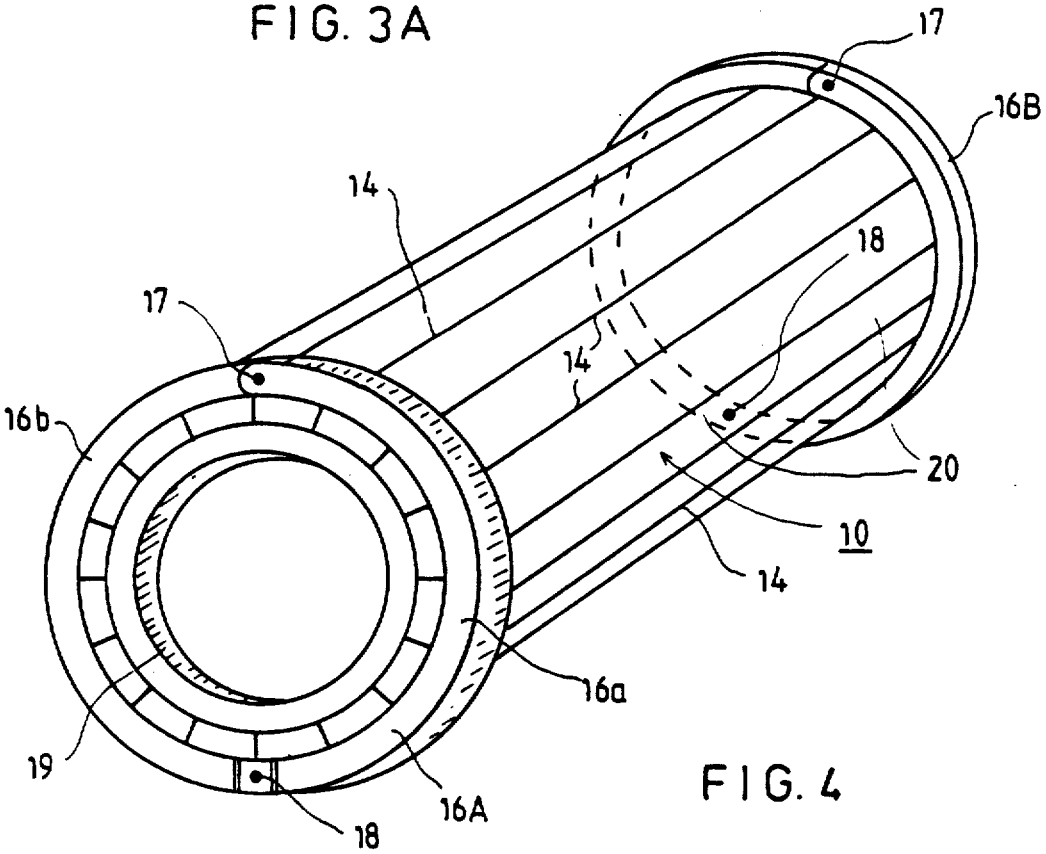
FIG. 4 shows a roll blank assembled out of mantle portions before the stage of EB-welding.

As is shown in FIG. 4, the roll parts 20 have been assembled into a roll-mantle blank 10 by making use of inner rings 19 and of outer rings 16A and 16B. The outer rings 16A and 16B consist of two parts 16*a* and 16*b*, which are connected to each other, e.g., by means of shaft pins 1 and/or 18. The parts 16*a* and 16*b* of the outer rings 16A and 16B can be tightened, e.g., by means of a suitable hydraulic tool (not shown). Owing to the rings 16A and 16B, for example an area of about 2×20 mm remains unwelded at the ends of the mantle 10, but this is only about 0.5 percent of the entire mass of the roll mantle 10.

Figure 5:
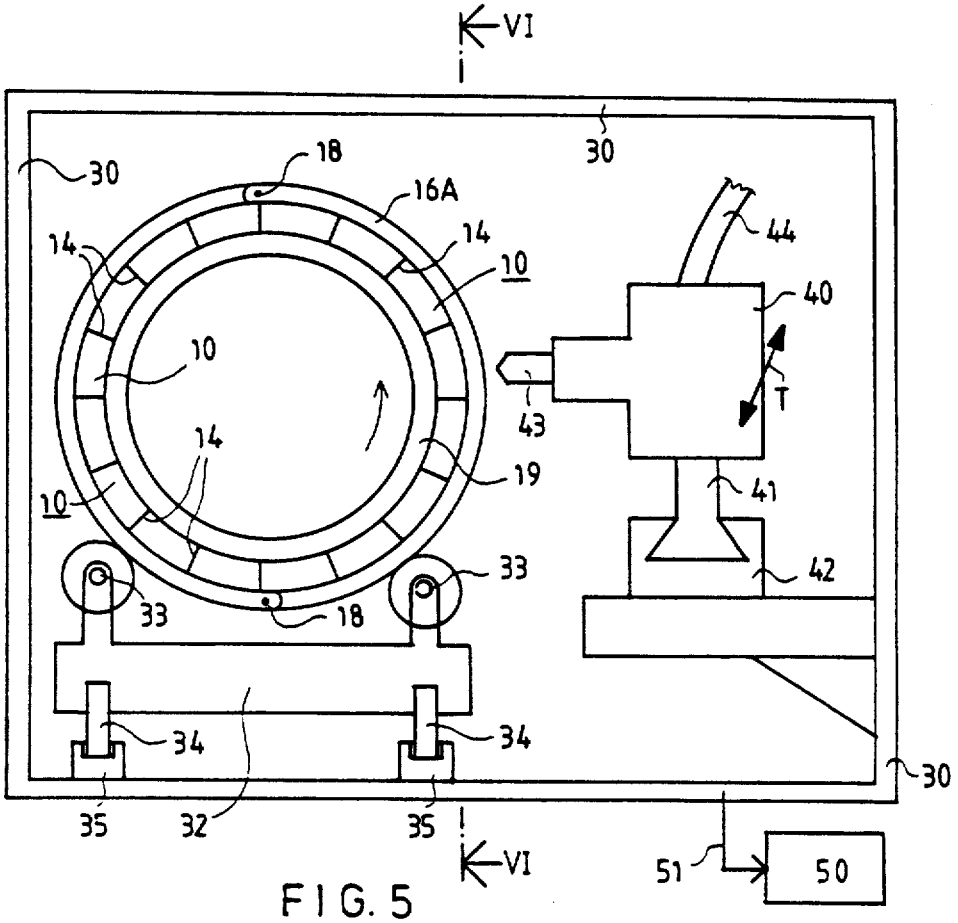
FIG. 5 is a vertical cross-sectional view of an EB-welding device applied in the invention, in whose interior the roll mantle to be welded is fitted.
Figure 6:
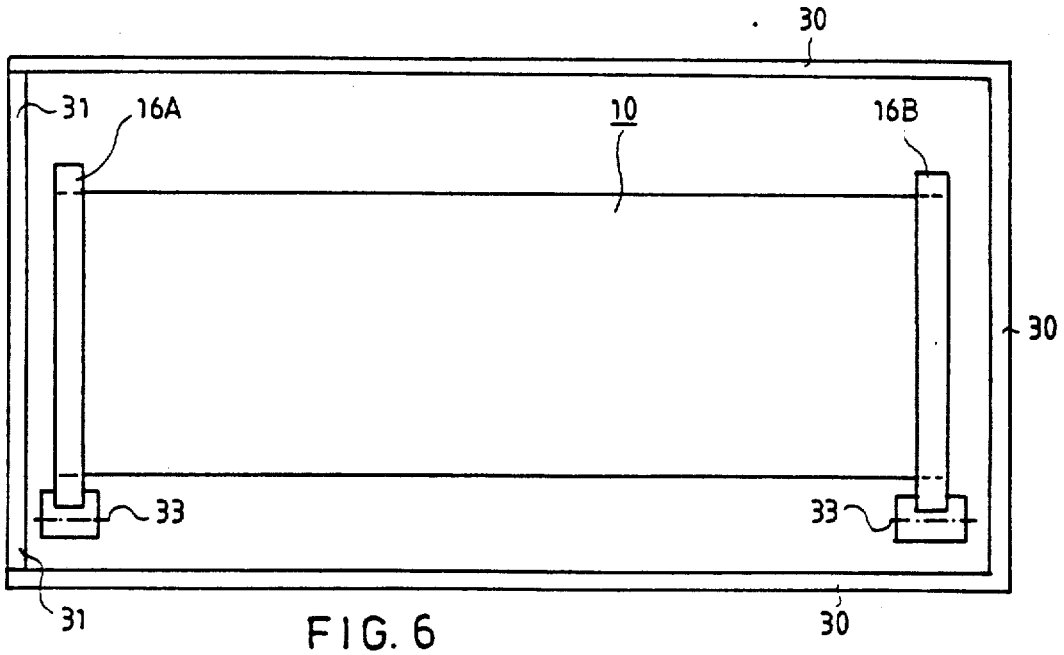
FIG. 6 is a vertical sectional view along the line VI—VI in FIG. 5.

The blank shown in FIG. 4, together with its fastening members 16A, 16B and 19, is lifted onto a carriage 32 having two pairs of rolls 33, 34. The rolls 33 are provided with grooves corresponding to the outer-ring parts 16A and 16B so that the roll-mantle blank 10 can be rotated on the pairs of rolls 33 while supported by means of the ring parts 16A and 16. The carriage 32 is pushed through the door 31 of the vacuum chamber 30 into the vacuum chamber 30 on the rails 35 and the carriage wheels 34. In the vacuum chamber 30, an EB-welding device 40 is placed, which travels on the guide 42 and on a corresponding projection part 41 across the entire axial length of the roll blank 10. The EB-welding device 40 is provided with a welding head 43, which has a suitable accelerating voltage U in relation to the mantle blank 10. The necessary DC electric power is supplied through the cable 44 from a suitable source of DC electricity (not shown). The EB-welding is carried out by means of the device described above so that the mantle blank 10 is rotated on the rolls 30 and locked in its position so that the joint area 14 between the parts is placed facing the welding head 43. Hereupon the voltage U is switched on to the welding head 43, and the joint 14 is prepared by means of electron-beam welding while the EB-device 40 traverses across the entire roll mantle over the distance between the outer-ring parts 16A and 16B. After one joint 14 has been completed, the roll blank is rotated again to the position of the next joint 14, and the EB-welding device 40 traverses in the opposition direction and prepares the second joint. This is continued until all the joints 14 have been prepared, whereupon the roll mantle 10 is transferred on the carriage 32 out of the welding chamber and is turned to a vertical position for the purpose of the heat-treatment stage in itself known. FIG. 5 shows schematically a vacuum pump 50, which sucks a suitable vacuum level into the chamber 30 through the pipe 51.

In the following examples,

W = output of electron gun in the welding head of the EB-device
d = wall thickness of mantle to be welded
U = accelerating voltage of electron gun
I = welding current
v = speed of preparation of joint 14 between the parts 20.

EXAMPLE 1

W = 30 kW
d = 100 mm
U = 150 kV
I = 180 mA
v = 0.5 m/min.

EXAMPLE 2

W = 40 kW
d = 100 mm
U = 100 kV
I = 40 mA
v = 0.1 m/min.

In using the invention, electron-beam welding is preferable to conventional welding also because the thermal energies produced in this welding are only about one hundreth of the thermal energies produced in conventional methods, for which reason the deformations arising in the roll mantle because of the welding are within permitted limits.

In the following, the patent claims will be given, whereby the various details of the invention may show variation within the scope of the inventive idea defined in these claims.

What is claimed is:

1. A method for manufacturing a cylindrical mantle having a certain length for rolls or cylinders of a paper machine out of a corrosion-proof metal or alloy material, said method comprising cutting a plurality of oblong plate blanks out of a planar plate of said corrosion-proof metal or alloy material, said oblong plate blanks after being cut being of a length equal to said certain length of said cylindrical mantle; and thereafter milling or planing said cut plurality of plate blanks until each plate blank is of an arcuate shape equivalent to a cylindrical portion of an assembled cylindrical mantle, said plate blanks having a length equal to said certain length; and thereafter electron-beam welding together adjacent ones of said plurality of plate blanks along a longitudinal axis of said cylindrical mantle, thereby forming said cylindrical mantle.

2. The method of claim 1 further comprising further machining said cylindrical mantle to achieve a substantially circular cross-sectional shape of inner and outer walls of said cylindrical mantle.

3. The method of claim 1 comprising said plurality of plate blanks being at least six and not more than seventy in number.

4. The method of claim 1 wherein said oblong plate blanks are made of extensively alloyed two-phase steel.

5. The method of claim 4 wherein said two-phase steel is a CrNi alloyed refined steel.

6. The method of claim 1 wherein said cutting step results in said oblong plate blanks having a trapezoidal cross-section.

7. The method of claim 1 further comprising, after said electron-beam welding of said plate blanks, heat treating said cylindrical mantle.

* * * * *